US009937939B2

(12) United States Patent
Kono et al.

(10) Patent No.: US 9,937,939 B2
(45) Date of Patent: Apr. 10, 2018

(54) RAILWAY VEHICLE OPERATION

(71) Applicant: Hitachi, Ltd., Tokyo (JP)

(72) Inventors: Toshiaki Kono, Tokyo (JP); Hiroto Sasaki, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 15/057,172

(22) Filed: Mar. 1, 2016

(65) Prior Publication Data

US 2016/0257324 A1 Sep. 8, 2016

(30) Foreign Application Priority Data

Mar. 2, 2015 (GB) ..... 1503482.0

(51) Int. Cl.
*B61L 27/00* (2006.01)
*B61L 25/02* (2006.01)
(Continued)

(52) U.S. Cl.
CPC ..... *B61L 27/0094* (2013.01); *B61L 3/006* (2013.01); *B61L 3/008* (2013.01); *B61L 25/021* (2013.01);
(Continued)

(58) Field of Classification Search
CPC ..... B61L 27/00; B61L 27/02; B61L 27/0038; B61L 27/0077; B61L 27/0094
(Continued)

(56) References Cited

U.S. PATENT DOCUMENTS 6,144,901 A * 11/2000 Nickles ..... B60T 13/665 701/19
6,263,266 B1 * 7/2001 Hawthorne ..... B60T 13/665 246/1 R
(Continued)

FOREIGN PATENT DOCUMENTS

JP 5-105081 A 4/1993
JP 2006-320093 A 11/2006
(Continued)

OTHER PUBLICATIONS

Japanese Office Action received in corresponding Japanese Application No. 2016-036607 dated Dec. 6, 2016.

*Primary Examiner* — Kimberly S Berona
*Assistant Examiner* — Anshul Sood
(74) *Attorney, Agent, or Firm* — Mattingly & Malur, PC

(57) ABSTRACT

A method of operating a railway vehicle on a network of tracks forming one or more vehicle routes, includes providing: vehicle status information including the present track location of the vehicle, the route to be taken by the vehicle and operation profile information relating vehicle operational recommendations and/or requirements to track locations and to vehicle routes; and determining operational risks for the vehicle from the vehicle status information, the route to be taken by the vehicle and the operation profile information, each operational risk being the likelihood of future vehicle operation departing from the operation profile information at a given section of track or a given location on the route. Advisory notices for a driver of the vehicle are generated on the basis of the operational risks, and each advisory notice, when acted on by the driver, reduces the likelihood of future vehicle operation departing from the operation profile information.

20 Claims, 4 Drawing Sheets

(51) Int. Cl.
*B61L 3/00* (2006.01)
*B61L 15/00* (2006.01)

(52) U.S. Cl.
CPC ..... *B61L 25/025* (2013.01); *B61L 27/0038* (2013.01); *B61L 27/0077* (2013.01); *B61L 15/0027* (2013.01)

(58) Field of Classification Search
USPC ..... 701/19
See application file for complete search history.

(56) References Cited

U.S. PATENT DOCUMENTS

2008/0269967 A1* 10/2008 Kumar ..... B61L 27/0027 701/20
2009/0216395 A1* 8/2009 Kernwein ..... B61L 25/025 701/20

FOREIGN PATENT DOCUMENTS

JP 2009-292434 A 2/2009
JP 2012-20712 A 2/2012
JP 2014-90556 A 5/2014
WO 2012/117070 A1 9/2012

* cited by examiner

RAILWAY VEHICLE OPERATION

FIELD OF THE INVENTION

The present invention relates to a method and system for operating a railway vehicle.

BACKGROUND

Efficient railway vehicle operation is strongly affected by railway infrastructure condition and other considerations across a railway network. A vehicle driver has to follow operational requirements or recommendations defined for different sections of track, and on occasions the driver has to pay special attention in specific locations due to e.g. track gradients reducing braking effectiveness, slippery rails, low visibility due to bad weather, temporary speed restrictions etc. This information can be considered as location-based, operation profile information.

Driver assistance systems (DAS) of known type can be used to provide driving speed recommendations to railway vehicle drivers, typically in order to improve vehicle operational efficiency. However, even with such systems there is a possibility of driver error if the driver does not follow the recommendations. Further such systems do not address wider issues of operational mistakes by drivers unrelated to vehicle operational efficiency.

SUMMARY

In a first aspect, the present invention provides a method of operating a railway vehicle on a network of tracks forming one or more vehicle routes, the method including steps of:

- providing vehicle status information including the present track location of the vehicle;
- providing the route to be taken by the vehicle;
- providing operation profile information relating vehicle operational recommendations and/or requirements to track locations and to vehicle routes;
- determining operational risks for the vehicle from the vehicle status information, the route to be taken by the vehicle and the operation profile information, each operational risk being the likelihood of future vehicle operation departing from the operation profile information at a given section of track or a given location on the route; and
- generating advisory notices for a driver of the vehicle on the basis of the operational risks, each advisory notice, when acted on by the driver, reducing the likelihood of future vehicle operation departing from the operation profile information.

Thus the method provides location-based advisory notices to a railway vehicle driver that can help to improve, for example, safety, reliability and passenger comfort of railway operation.

The method of the first aspect may have any one or, to the extent that they are compatible, any combination of the following optional features.

The vehicle status information may further includes the present speed of the vehicle and/or the present direction of travel of the vehicle.

The vehicle status information can further include indicators confirming actuation of vehicle controls (e.g. actuation of vehicle brakes, doors etc.) and/or vehicle sensor measurements.

The vehicle operational recommendations can include preferred speed profiles along the vehicle routes, e.g. optimized for energy efficiency. The vehicle operational requirements can include vehicle door operation requirements at locations on the network e.g. corresponding to stations.

The advisory notice may include risks of vehicle operation failure and/or error which the driver may cause in the future.

The method may further including a step of: providing network status information including present network signal positions and present network speed restrictions; wherein the generation of advisory notices are suppressed when those notices, if acted on by the driver, would conflict with the present network signal positions and present network speed restrictions.

The method may further include a step of: providing past operation information relating records of previous vehicle operations to track locations and to vehicle routes; wherein the operational risk for the vehicle is also determined from the past operation information. In this way, the method can benefit from accumulated experience of running vehicle operations on the network.

The operation profile information may include preferred speed profiles along the vehicle routes. In this case, the method may further include: determining a present speed target for the vehicle from the present track location and the preferred speed profiles; and separately from the generation of the advisory notices, displaying the present speed target to the driver of the vehicle.

The operational risks may be determined at a ground-side location, the method may further include communicating the operational risks to the vehicle, and the advisory notices may be generated on-board the vehicle.

In a second aspect, the present invention provides a system for improving the operation of a railway vehicle on a network of tracks forming one or more vehicle routes, the system including:

- a measurement sub-system to obtain vehicle status information including the present track location of the vehicle;
- a route database storing the route to be taken by the vehicle;
- an operation profile database storing operation profile information relating vehicle operational recommendations and/or requirements to track locations and to vehicle routes;
- a first processor unit for determining operational risks for the vehicle from the present track location, the route to be taken by the vehicle and the operation profile information, each operational risk being the likelihood of future vehicle operation departing from the operation profile information at a given section of track or a given location on the route;
- a second processor unit for generating advisory notices for a driver of the vehicle on the basis of the operational risks, each advisory notice, when acted on by the driver, reducing the likelihood of future vehicle operation departing from the operation profile information; and
- a driver interface device for presenting the advisory notices to the driver.

Thus the system of the second aspect corresponds to the method of the first aspect. Optional features of the method of the first aspect produce corresponding optional features in the system of the second aspect.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES

Figure 1:
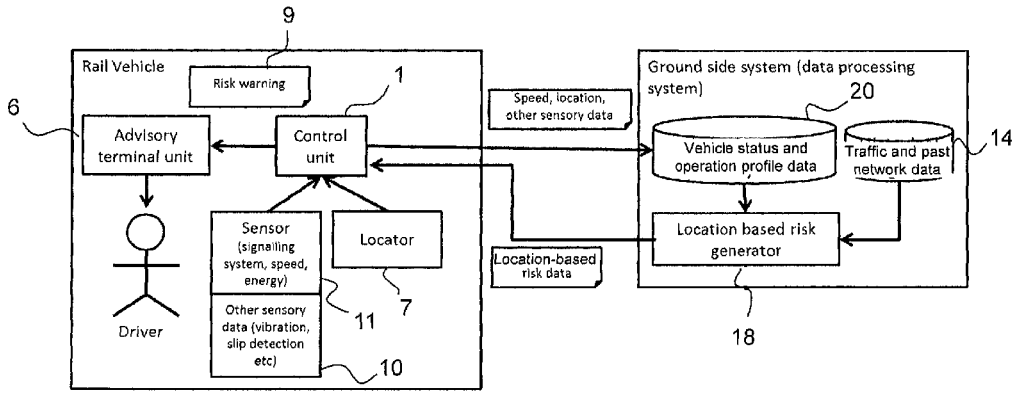
FIG. 1 shows schematically an overview of a location-based advisory system for a driver of a railway vehicle.

The ensuing description provides preferred exemplary embodiment(s) only, and is not intended to limit the scope, applicability or configuration of the invention. Rather, the ensuing description of the preferred exemplary embodiment(s) will provide those skilled in the art with an enabling description for implementing a preferred exemplary embodiment of the invention, it being understood that various changes may be made in the function and arrangement of elements without departing from the scope of the invention.

Specific details are given in the following description to provide a thorough understanding of the embodiments. However, it will be understood by one of ordinary skill in the art that embodiments maybe practiced without these specific details. For example, well-known circuits, processes, algorithms, structures, and techniques may be shown without unnecessary detail in order to avoid obscuring the embodiments.

Also, it is noted that embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

As disclosed herein, the term "computer readable medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" includes, but is not limited to portable or fixed storage devices, optical storage devices, wireless channels and various other mediums capable of storing, containing or carrying instruction(s) and/or data.

Furthermore, embodiments may be implemented by hardware, software, firmware, middleware, microcode, hardware description languages, or any combination thereof. When implemented in software, firmware, middleware or microcode, the program code or code segments to perform the necessary tasks may be stored in a machine readable medium such as storage medium. A processor(s) may perform the necessary tasks. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

Railway vehicle condition monitoring systems (CMSs) are becoming more widely used due to the evolution of IT and communication systems. However, CMSs can also enable monitoring of infrastructure and driver action, not just vehicle condition. Further, data derived from CMSs, allows operational and infrastructural risk to be identified such that location-based risk databases can be generated. Such a database, can be utilised in various ways to improve safety, reliability and passenger comfort during railway operations.

In particular, it possible to provide a location-based advisory or education system to a driver based on an operational risk database generated from (i) vehicle status information and (ii) operation profile information relating vehicle operational recommendations and/or requirements to track locations and to vehicle routes.

Figure 2:
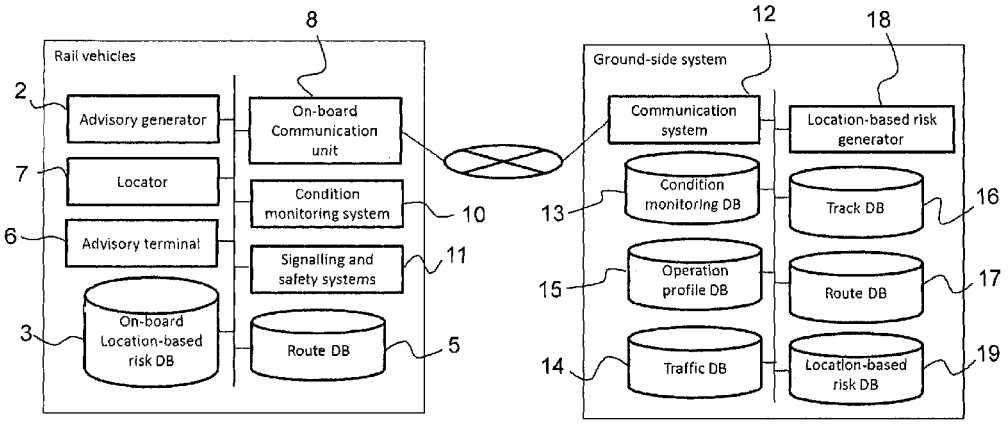
FIG. 2 shows in more detail elements of the system of FIG. 1.

FIG. 1 shows schematically an overview of such a system. At the left hand side are elements of the system installed on-board a railway vehicle. These elements may be duplicated in further vehicles. At the right hand side are elements of the system installed ground-side. FIG. 2 shows in more detail elements of the system.

Referring first to the on-board elements, a control unit 1 shown in FIG. 1 includes the following elements of FIG. 2, namely: an advisory generator 2, an on-board location-based risk database (DB) 3, an on-board communication unit 8 and a route DB 5.

The advisory generator 2 generates advisory notices 9 for the driver and sends them to an advisory terminal 6. The notices include potential risks of operational failure or error which the driver may cause in the future. The notices 9 are created from information held by the on-board location based risk DB 3. The notice creation also takes into account information such as the location of the vehicle, and route data obtained from the route DB 5. It may also take into account the vehicle speed and direction, and restrictions from signalling and sensory systems.

A locator 7 determines the location of the vehicle on its route, for example by GPS, track-based transponder, camera, odometer or any other location estimation apparatus. A CMS 10 records on-board information from the vehicle, such as sensory data, driver operation data, CCTV data etc. The combination of the locator 7 and the CMS 10 can be considered as vehicle status information measurement subsystem. The advisory terminal 6 issues the advisory notices 9 for the driver by visual display or by sound. It may also accept the driver's input as acknowledgement of receipt of a notice. The on-board location-based risk DB 3 stores location-based risk data sent by the ground-side part of the system. The on-board communication unit 8 communicates data between the on-board and ground-side parts of the system. A signalling and safety sub-system 11 sends operational restrictions, such as speed limits and stop signals to the advisory generator 2. The restrictions can be obtained by sensors or communication systems included in conventional signalling and safety sub-systems.

Turning to the ground-side elements, a communication system 12 communicates with the on-board communication unit 8. A condition monitoring DB 13 keeps the status data collected by the on-board CMS 10 as well as the location information from the locator 7. A traffic DB 14 keeps identification and movement records of vehicles in and around a target area, and signalling and safety data for the area. It can also store past track network records. For example, the records may include information such as, vehicle type, previous vehicle locations, previous network signals and restrictions etc. The data in the traffic DB 14 can be regularly updated. An operation profile DB 15 stores data relating vehicle operational recommendations and/or requirements to track locations and to vehicle routes. In particular, this DB can store patterns of ideal or correct vehicle operation, such as optimised along routes at different times. A track DB 16 stores route and infrastructure data, such as signal locations. A route DB 17 stores the routes of the vehicles in the target area. The respective route information from this DB is sent to the vehicle's own on-board route DB 5. A vehicle status and operation profile DB 20 shown in FIG. 1 includes the following elements of FIG. 2: the condition monitoring DB 13, the operation profile DB 15, the track DB 16 and the route DB 17.

A location-based risk generator 18 determines an operational risk for the vehicles in the target area from respective vehicle status information and respective operation profile information, the operational risk being the likelihood of future vehicle operation departing from the operation profile information in the operation profile DB 15. In particular, for each vehicle, the location-based risk generator 18 can calculate the risk using the information from the condition monitoring DB 13, the traffic DB 14, the track DB 16, and the route DB 17. The risk data can then be saved in an optional location-based risk DB 19 for onward transmission to the on-board location based risk DB 3. Alternatively, the risk data can be transmitted directly to the on-board location based risk DB 3.

Next, the functioning of system is explained. The CMS 10 collects and records how the vehicle is operated, such as actual speed, braking points, lever and button operation, correlated with location and time information using the locator 7. The location data includes direction of travel as well as the position on the track. Ground-side systems can also be used to decide vehicle locations. The CMS data can also include signalling and safety data from the signalling and safety sub-system 11, as such data may be different for different operations even if the location is same.

The collected on-board status data (i.e. location, direction of travel, CMS data) is sent to the ground-side part of the system by the on-board communication unit 8, which may be based on e.g. mobile phone communication, internet, radio and/or offline data collection by memory card or hard disk. Examples of collected speed data are shown in Table 1, and examples of collected event data are shown in Table 2 (door release operation).

TABLE 1

Speed data from vehicles

| Timestamp | Sender | Location on track | Direction | Sensory data and detection | |
|---|---|---|---|---|---|
| 15/09/2014 11:05:15 | Train 1 | 11542 m | Up | Speed | 30 m/s |
| 15/09/2014 11:05:16 | Train 1 | 11572 m | Up | Speed | 28 m/s |
| 15/09/2014 11:05:17 | Train 1 | 11600 m | Up | Speed | 25 m/s |

TABLE 1-continued

Speed data from vehicles

| Timestamp | Sender | Location on track | Direction | Sensory data and detection | |
|---|---|---|---|---|---|
| 15/09/2014 11:05:18 | Train 1 | 11625 m | Up | Speed | 20 m/s |
| 15/09/2014 11:05:19 | Train 1 | 11645 m | Up | Speed | 15 m/s |
| 15/09/2014 11:05:20 | Train 1 | 11660 m | Up | Speed | 12 m/s |
| 15/09/2014 11:05:21 | Train 1 | 11672 m | Up | Speed | 10 m/s |
| 15/09/2014 11:05:22 | Train 1 | 11682 m | Up | Speed | 5 m/s |
| 15/09/2014 11:05:23 | Train 1 | 11687 m | Up | Speed | 0 m/s |
| 15/09/2014 11:05:24 | Train 1 | 11687 m | Up | Speed | 0 m/s |
| - | - | - | - | - | |
| - | - | - | - | - | |
| - | - | - | - | - | |
| 16/09/2014 20:10:01 | Train 2 | 11550 m | Up | Speed | 31 m/s |
| 16/09/2014 20:10:02 | Train 2 | 11581 m | Up | Speed | 27 m/s |
| 16/09/2014 20:10:03 | Train 2 | 11608 m | Up | Speed | 25 m/s |
| 16/09/2014 20:10:04 | Train 2 | 11633 m | Up | Speed | 19 m/s |
| 16/09/2014 20:10:05 | Train 2 | 11652 m | Up | Speed | 15 m/s |
| 16/09/2014 20:10:06 | Train 2 | 11667 m | Up | Speed | 11 m/s |
| 16/09/2014 20:10:07 | Train 2 | 11678 m | Up | Speed | 5 m/s |
| 16/09/2014 20:10:08 | Train 2 | 11683 m | Up | Speed | 0 m/s |

TABLE 2

Event data from vehicles

| Timestamp | Sender | Location on track | Direction | Event |
|---|---|---|---|---|
| 15/10/2014 13:08:10 | Train 3 | Line A 31025 m | Up | Door release operation (right) |
| 15/10/2014 13:08:30 | Train 3 | Line A 31025 m | Up | Door release operation (right) |
| 15/10/2014 13:09:00 | Train 3 | Line A 31025 m | Up | Door release operation (left) |
| 17/10/2014 09:10:00 | Train 4 | Line A 31026 m | Up | Door release operation (right) |
| 17/10/2014 09:10:30 | Train 4 | Line A 31026 m | Up | Door release operation (left) |
| 03/12/2014 20:47:13 | Train 5 | Line A 31024 m | Up | Door release operation (right) |
| 03/12/2014 20:47:43 | Train 5 | Line A 31024 m | Up | Door release operation (left) |

The ground-side system receives collected on-board status data from different vehicles and saves it into the condition monitoring DB 13.

In the meantime the operation profile DB 15 stores patterns of ideal or correct vehicle operation. For example, this DB can keep preferred speed profiles along routes e.g. optimized for energy efficiency. An example is shown in Table 3. These profiles may not be realised in practice, however, e.g. due to driver non-ideal operation, or separately imposed operation restrictions.

TABLE 3

Operation profile data (energy optimized speed profile)

| Location on track | Direction | Speed |
|---|---|---|
| Line A 11500 m | Up | 30 m/s |
| Line A 11510 m | Up | 30 m/s |
| Line A 11520 m | Up | 30 m/s |
| Line A 11530 m | Up | 30 m/s |
| Line A 11540 m | Up | 30 m/s |
| Line A 11550 m | Up | 27 m/s |
| Line A 11560 m | Up | 23 m/s |
| Line A 11570 m | Up | 20 m/s |
| Line A 11580 m | Up | 18 m/s |
| Line A 11590 m | Up | 16 m/s |
| Line A 11600 m | Up | 14 m/s |
| Line A 11610 m | Up | 12 m/s |

TABLE 3-continued

| Operation profile data (energy optimized speed profile) | | |
|---|---|---|
| Location on track | Direction | Speed |
| Line A 11620 m | Up | 10 m/s |
| Line A 11630 m | Up | 8 m/s |
| Line A 11650 m | Up | 6 m/s |
| Line A 11660 m | Up | 4 m/s |
| Line A 11670 m | Up | 3 m/s |
| Line A 11680 m | Up | 2 m/s |
| Line A 11690 m | Up | 1 m/s |
| Line A 11700 m | Up | 0 m/s |

The operation profile DB 15 can also store other operation profiles, for example, patterns of operation of doors at stations, as illustrated for example in Table 4. Thus in the operation profile DB 15, these profiles are related to track locations and routes.

TABLE 4

| Operation profile data (event profile) | |
|---|---|
| Location | Operation |
| Station A (Line A 31020-31120, Up) | Release door (left side) |
| Station A (Line A 31020-31120, Up) | Open door (left side) |
| Station A (Line A 31020-31120, Up) | Close and Lock door (left side) |

The operation profile data can be determined empirically or non-empirically. Thus, one option is to input the profiles manually. For example, patterns of door release at stations must obey fixed rules which can be manually inputted. Another option is to determine the profile data by machine learning. For example, energy efficient speed profiles can be obtained from actual vehicle running results (see for example WO 2012/117070, herein incorporated by reference). Operation profiles are also can be based on from CMS data. For example, as driver failure rates are generally low, a statistical analysis of past operations can help define correct operation profiles, and/or sequences of correct operational states can be automatically extracted from CMS data.

Operational failure can be defined as a departure of vehicle operation from an ideal or correct operation is recorded in operation profile DB 15. Operational risk is then the likelihood of operational failure. By comparing data in the operation profile DB 15 and actual operation recorded in condition monitoring DB 13, the location-based risk generator 18 calculates this risk for sections of routes for each type of operational failure.

Figure 3:
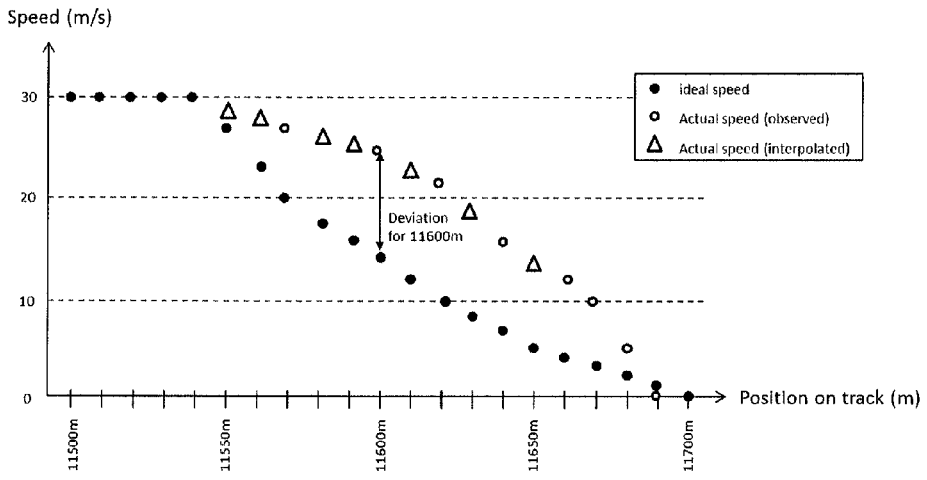
FIG. 3 shows ideal and actual speed profiles for a section of track.

An example is departure (over speed) of an operational speed profile from an ideal profile. Table 1 shows speed profiles for the running of actual vehicles run stored in the condition monitoring DB 13. Table 3 is an optimised profile that drivers are encouraged to follow. It is possible to calculate the difference between these two profiles. As shown in FIG. 3, the track can be separated into small sections, for example 10 m in length, and the ideal speed set for each section. The actual speed data can be plotted to each section by interpolating the collected speed data. Then the deviation for each section can be defined as the speed difference between the ideal speed and actual speed. The deviation at the 11600 m section is indicated in FIG. 3. Similar deviation data can be calculated for each passage of a vehicle. The average deviation can then be calculated over a time window, such as the last month, for each section. It is possible to exclude from the averaged sample vehicle passages which occurred under some special speed restriction, e.g. due to weather conditions, operation conditions (e.g. delays in earlier trains), application of emergency brakes, vehicle failures or other reasons. The exclusion data can be obtained from the signalling and safety sub-system 11 and/or data recorded in the traffic DB 14.

If the deviations are relatively large, it is possible to conclude a given section has a higher risk of over speed. For example, it is possible to define the average deviation/ideal speed ratio as a score for the risk of over speed. In such a way, we can define risk of over speed as shown in Table 5.

TABLE 5

| Location-based risk data | | | |
|---|---|---|---|
| Location on track | Direction | Type of risk | Score |
| Line A 11550 m | Up | Overspeed | 0.13 |
| Line A 11560 m | Up | Overspeed | 0.28 |
| Line A 11570 m | Up | Overspeed | 0.40 |
| Line A 11580 m | Up | Overspeed | 0.50 |
| Line A 11590 m | Up | Overspeed | 0.66 |
| Line A 11600 m | Up | Overspeed | 0.82 |
| Line A 11610 m | Up | Overspeed | 1.00 |
| Line A 11620 m | Up | Overspeed | 1.35 |
| Line A 11630 m | Up | Overspeed | 1.25 |
| Line A 11650 m | Up | Overspeed | 1.50 |
| Line A 11660 m | Up | Overspeed | 2.13 |
| Line A 11670 m | Up | Overspeed | 2.33 |
| Line A 11680 m | Up | Overspeed | 1.50 |
| Line A 31020 m | Up | Wrong side door release | — |

Another example is the risk of door operation failure occurrence (e.g. the wrong door being opened). When a vehicle stops at a station, which doors should be opened are predefined according to platform and vehicle layout (e.g. platform on left/right side of vehicle, length of platform and vehicle). But occasionally a driver may command the wrong door to open. This is a safety critical incident because of the danger to passengers of falling onto the track. Generally, modern trains have systems to prevent the wrong doors being opened, but nonetheless mistakenly commanding the wrong door to open is still not desirable, as it can confuse the driver and cause operational delays.

This kind of mistake is sometimes caused by location-related reasons, such as a short platform compared to other stations on the route, a confusing station layout, or only one station on a route having a different opening side. Being able to provide a risk warning in advance can prevent safety critical incidents or operational delays.

By comparing the event data shown in Table 2 and the operation profile data shown in Table 4, it is possible to calculate operational failure rates within given track locations. There are various methods to recognize operational failures. A simple approach correlates location data and event data in the condition monitoring DB 13 and compares this with the corresponding operation profile in the data operation profile DB 15. If the same operation is described in the operational profile, the system categorises the event as being correct. If not, the system categorises it is as an operational failure. By calculating operational failure rates at the location, the system generates a location-based risk for the particular operation. Table 5 includes such a result in its final row.

For speed profiles, another example is the relation between delay and speed deviation. In contrast to over speeding, a lower speed than target can also be a problem because it may cause delay.

Figure 4:
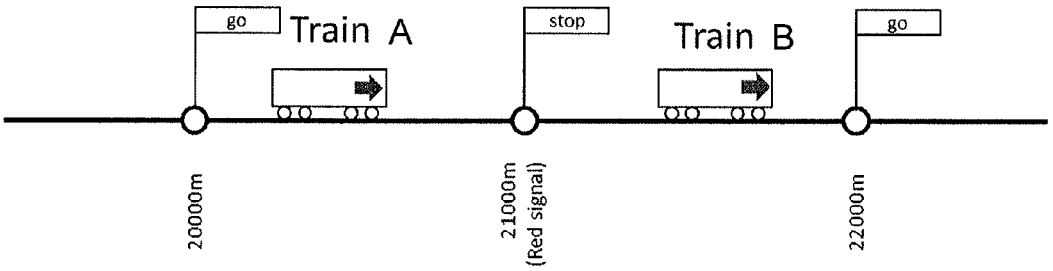
FIG. 4 shows schematically two railways vehicles A and B on adjacent sections of track.
Figure 5:
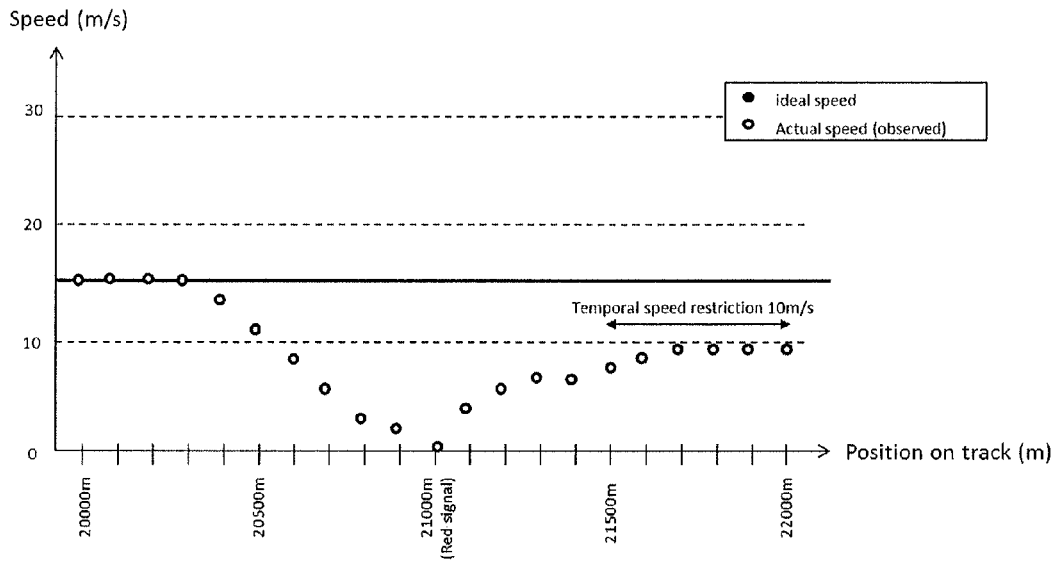
FIG. 5 shows the ideal and actual speed profiles of vehicle A when travelling along the sections of track of FIG. 4.

FIGS. 4 and 5 illustrate the example. Consider data from vehicle A in FIG. 4. Because Vehicle B is located between 21,000 m and 22,000 m, the red stop signal is set at 21,000 m. This forces vehicle A to stop within the interval 20,000 m to 21,000 m. After 21,000 m, a speed restriction may be set for vehicle A in the interval between 21,000 m to 22,000 m. Table 6 show the corresponding data from the condition monitoring DB 13, Table 7 show the corresponding data from track DB 16, and Table 8 show the corresponding data from the traffic DB 14.

TABLE 6

Example of location and speed data

| Timestamp | Sender | Location on track | Direction | Sensory data and detection | |
|---|---|---|---|---|---|
| 15/09/2014 11:05:15 | Train 3 | Line B 20000 m | Up | Speed | 15 m/s |
| 15/09/2014 11:05:22 | Train 3 | Line B 20100 m | Up | Speed | 15 m/s |
| 15/09/2014 11:05:28 | Train 3 | Line B 20200 m | Up | Speed | 15 m/s |
| 15/09/2014 11:05:35 | Train 3 | Line B 20300 m | Up | Speed | 15 m/s |
| 15/09/2014 11:05:42 | Train 3 | Line B 20400 m | Up | Speed | 14 m/s |
| 15/09/2014 11:05:50 | Train 3 | Line B 20500 m | Up | Speed | 11 m/s |
| 15/09/2014 11:05:59 | Train 3 | Line B 20600 m | Up | Speed | 9 m/s |
| 15/09/2014 11:06:10 | Train 3 | Line B 20700 m | Up | Speed | 6 m/s |
| 15/09/2014 11:06:27 | Train 3 | Line B 20800 m | Up | Speed | 4 m/s |
| 15/09/2014 11:06:52 | Train 3 | Line B 20900 m | Up | Speed | 2 m/s |
| 15/09/2014 11:07:42 | Train 3 | Line B 21000 m | Up | Speed | 0 m/s |
| 15/09/2014 11:09:00 | Train 3 | Line B 21100 m | Up | Speed | 4 m/s |
| 15/09/2014 11:09:25 | Train 3 | Line B 21200 m | Up | Speed | 5 m/s |
| 15/09/2014 11:09:45 | Train 3 | Line B 21300 m | Up | Speed | 6 m/s |
| 15/09/2014 11:10:01 | Train 3 | Line B 21400 m | Up | Speed | 6 m/s |
| 15/09/2014 11:10:17 | Train 3 | Line B 21500 m | Up | Speed | 7 m/s |
| 15/09/2014 11:10:31 | Train 3 | Line B 21600 m | Up | Speed | 8 m/s |
| 15/09/2014 11:10:44 | Train 3 | Line B 21700 m | Up | Speed | 10 m/s |
| 15/09/2014 11:10:54 | Train 3 | Line B 21800 m | Up | Speed | 10 m/s |
| 15/09/2014 11:10:54 | Train 3 | Line B 21900 m | Up | Speed | 10 m/s |
| 15/09/2014 11:10:54 | Train 3 | Line B 22000 m | Up | Speed | 10 m/s |
| 15/09/2014 11:05:30 | Train 4 | Line B 21500 m | Up | Speed | 0 m/s |
| 15/09/2014 11:06:00 | Train 4 | Line B 21600 m | Up | Speed | 3 m/s |
| . | | | | | |
| . | | | | | |
| . | | | | | |

TABLE 7

Example of track data

| Infrastructure type | Location | | |
|---|---|---|---|
| Signal | Line B | Up | 20000 m |
| Signal | Line B | Up | 21000 m |
| Signal | Line B | Up | 22000 m |

TABLE 8

Example of traffic data

| Temporal restriction | Time start | Time end | Location | |
|---|---|---|---|---|
| Speed limit 10 m/s | 15/09/2014 10:30:00 | 15/09/2014 12:00:00 | Line B | 21500 m-22000 m |
| Speed limit 8 m/s | 16/09/2014 13:00:00 | 17/09/2014 13:00:00 | Line A | 10000 m-12000 m |
| Track closure | 17/09/2014 20:00:00 | 18/09/2014 05:00:00 | Line C | 500 m-1500 m |

Figure 6:
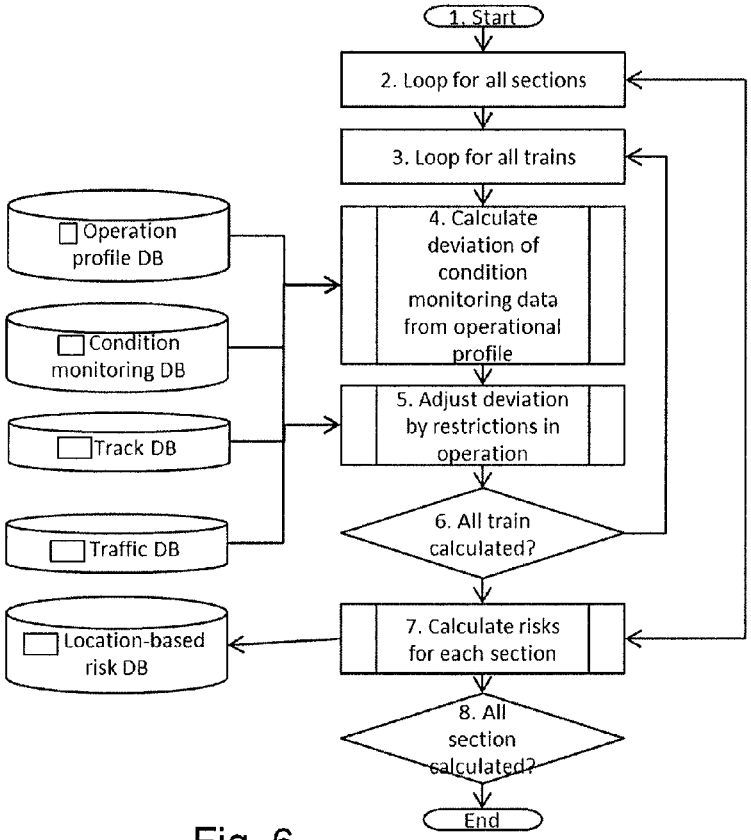
FIG. 6 shows a flowchart for risk generation by a location-based risk generator of the system of FIGS. 1 and 2.

FIG. 6 shows then a flowchart for risk generation by the location-based risk generator 18. The previous examples can follow similar procedures. In process 4, similar to the over speeding example, the deviation from target speed is calculated from the collected vehicle status data and the operation profile data. In process 5, the risk generator 18 refers to the condition monitoring DB 13 and the traffic DB 14 to determine if any traffic restrictions may be affecting the data recorded in the condition monitoring DB 13, and if yes the risk generator 18 removes these samples from subsequent processing because their deviations are not due to driver error. For example, samples can be removed when the red signal, such as caused by train B, produces vehicle under speed in the 20,000 m to 21,000 m section. Such samples can be recognised either by status data from train B or directly as a record of red signals from the traffic DB 14.

To keep the risk DB 19 updated, such calculations can be carried out when new data is recorded in condition monitoring DB 13, at regular time intervals, and/or when changes to routes or tracks occur.

The risk data is saved in the location-based risk DB 19 and also transmitted to the vehicle for storage in the on-board location-based risk DB 3. The route of the vehicle is predefined according to a service plan. The driver inputs the route (or usually, just chooses from a selection of routes) before start vehicle operation, the route being stored in the on-board route DB 5. Accordingly, it is possible to predict when and where the vehicle will be along the predefined route, and for the advisory generator 2 to generate suitable and timely advisory notices for the driver in order to reduce the likelihood of vehicle operation departing from the operation profile information.

Figure 7:
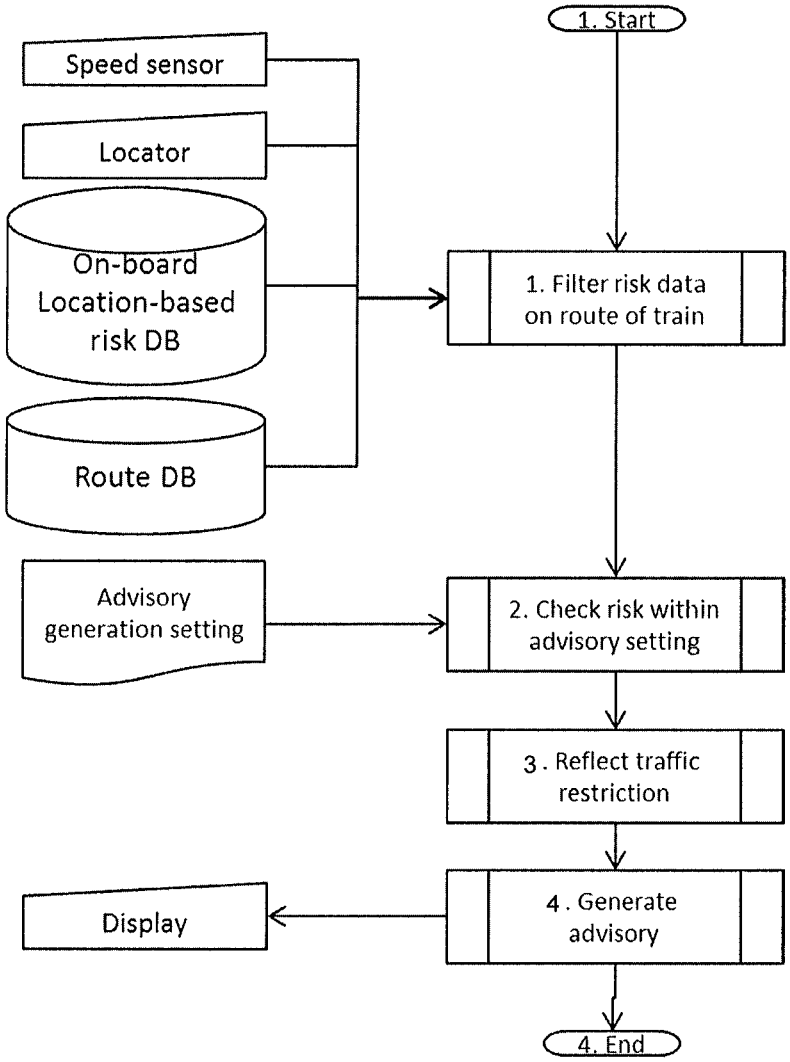
FIG. 7 shows a flowchart for real-time generation of an advisory notices by an advisory generator of the system of FIGS. 1 and 2.

FIG. 7 shows a flowchart for real-time generation of advisory notices for e.g. over speed by the advisory generator 2. This procedure can be executed at regular time intervals such as every second. In process 1, the risk data for the route is obtained by using the current location from the locator 7 and the route data in the on-board route DB 5. In process 2, the advisory generator 2 checks which risk data require advisory notices. That is, it checks whether the vehicle will pass a risk location within a predefined time or distance. These time or distance can be defined by settings of the advisory generator 2. In process 3, the advisory generator 2 excludes advisory notices which would conflict with the present network signal positions and present network speed restrictions as determined by the signalling and safety sub-system 11. For example, if a speed restriction is in place, an over speed risk advisory notice is irrelevant. An advisory notice is then generated in a visual display or sound format and provided to the driver through an on-board computer system or other driver interface device. It is possible to combine risks for adjacent track sections into one advisory notice.

The system can be used in conjunction with a conventional DAS system for providing driving speed recommendations to railway vehicle drivers. In this case, when the operation profile information includes preferred speed profiles along the vehicle routes, the DAS system can determine a present speed target for the vehicle from the present track location and the preferred speed profiles. The present speed target can be communicated to the vehicle. Then, separately from the generation of the advisory notices, the present speed target can be displayed to the driver of the vehicle.

The invention claimed is:

1. A method of operating a railway vehicle on a network of tracks forming one or more vehicle routes, the method including:

collecting on-board status data of actual operation of the vehicle using at least one sensor;

providing vehicle status information including the present track location of the vehicle and the on-board status data of actual operation of the vehicle;

providing the route to be taken by the vehicle;

providing operation profile information relating vehicle operational recommendations and/or requirements to track locations and to vehicle routes;

determining operational risks for the vehicle from the vehicle status information, the route to be taken by the vehicle and the operation profile information, each operational risk being the likelihood of future vehicle operation departing from the operation profile information at a given section of track or a given location on the route; and generating advisory notices for a driver of the vehicle on the basis of the operational risks, each advisory notice, when acted on by the driver, reducing the likelihood of future vehicle operation departing from the operation profile information;

wherein determining the operational risks for the vehicle includes comparing the on-board status data of actual operation of the vehicle and the operation profile information to calculate the operational risks;

wherein the on-board status data includes data on actuation of vehicle doors and the operation profile information includes vehicle door operation requirements at various locations including train stations; and wherein determining operational risks for the vehicle includes comparing the on-board status data on actuation of vehicle doors and vehicle door operation requirements to determine operational risks of door operation failure occurrence.

2. A method according to claim 1, wherein the vehicle status information further includes the present speed of the vehicle and/or the present direction of travel of the vehicle.

3. A method according to claim 1, further including:

providing network status information including present network signal positions and present network speed restrictions;

wherein the generation of the advisory notices are suppressed when the advisory notices, if acted on by the driver, would conflict with the present network signal positions and present network speed restrictions.

4. A method according to claim 1, further including:

providing past operation information relating records of previous vehicle operations of the vehicle to track locations and to vehicle routes;

wherein the operation profile information includes a statistical analysis of the previous vehicle operations related to track locations and to vehicle routes; and wherein the operational risk for the vehicle is also determined from the statistical analysis of the past operation information.

5. A method according to claim 1, wherein the operation profile information includes preferred speed profiles along the vehicle routes, and the method further includes:

determining a present speed target for the vehicle from the present track location and the preferred speed profiles; and separately from the generation of the advisory notices, displaying the present speed target to the driver of the vehicle.

6. A method according to claim 1, wherein the operational risks are determined at a ground-side location, the method further includes communicating the operational risks to the vehicle, and the advisory notices are generated on-board the vehicle.

7. A method according to claim 1, wherein the on-board status data includes at least one of vehicle operation sensor measurement, driver operation data, or CCTV data.

8. A method according to claim 1, wherein the on-board status data includes at least one of actuation of vehicle brakes or actuation of vehicle doors.

9. A method according to claim 1, further comprising:

providing traffic information which includes identification and movement records of vehicles in and around a target area, and signaling and safety data for the target area;

determining, based on the traffic information and the vehicle status information, whether any traffic restrictions are affecting the on-board status data of the vehicle status information; and if traffic restrictions are affecting the on-board status data of the vehicle status information, removing the affected status data from the vehicle status information so as not to use the affected status data in determining operational risks.

10. A system for improving the operation of a railway vehicle on a network of tracks forming one or more vehicle routes, the system including:

a measurement sub-system to obtain vehicle status information including the present track location of the vehicle and on-board status data of actual operation of the vehicle;

a route database storing the route to be taken by the vehicle;

an operation profile database storing operation profile information relating vehicle operational recommendations and/or requirements to track locations and to vehicle routes;

a traffic database storing traffic information which includes identification and movement records of vehicles in and around a target area, and signaling and safety data for the target area;

a first processor unit for determining operational risks for the vehicle from the present track location, the route to be taken by the vehicle and the operation profile information, each operational risk being the likelihood of future vehicle operation departing from the operation profile information at a given section of track or a given location on the route;

a second processor unit for generating advisory notices for a driver of the vehicle on the basis of the operational risks, each advisory notice, when acted on by the driver, reducing the likelihood of future vehicle operation departing from the operation profile information; and a driver interface device for presenting the advisory notices to the driver;

wherein determining the operational risks for the vehicle includes comparing the on-board status data of actual operation of the vehicle and the operation profile information to calculate the operational risks; and wherein the first processor unit is configured to determine, based on the traffic information and the vehicle status information, whether any traffic restrictions are affecting the on-board status data of the vehicle status information; and if traffic restrictions are affecting the on-board status data of the vehicle status information, remove the affected status data from the vehicle status information so as not to use the affected status data in determining operational risks.

11. A system according to claim 10, wherein the vehicle status information further includes the present speed of the vehicle and/or the present direction of travel of the vehicle.

12. A system according to claim 10, further including:

a signalling and safety sub-system providing network status information including present network signal positions and present network speed restrictions;

wherein the generation of the advisory notices are suppressed by the second processor unit when the advisory notices, if acted on by the driver, would conflict with the present network signal positions and present network speed restrictions.

13. A system according to claim 10, further including:

a past operations database storing past operation information relating records of previous vehicle operations of the vehicle to track locations and to vehicle routes;

wherein the operation profile information includes a statistical analysis of the previous vehicle operations related to track locations and to vehicle routes; and wherein the operational risk for the vehicle is also determined by the first processor unit from the statistical analysis of the past operation information.

14. A system according to claim 10, wherein the operation profile information includes preferred speed profiles along the vehicle routes, and the system further includes:

a sub-system for determining a present speed target for the vehicle from the present track location and the preferred speed profiles; and a display for displaying the present speed target to the driver of the vehicle separately from the advisory notices.

15. A system according to claim 10, wherein the operation profile database and the first processor unit are located ground-side, and the second processor unit is located on-board the vehicle, the system further including a communication arrangement for communicating the operational risks to the vehicle.

16. A system according to claim 10, wherein the on-board status data includes at least one of vehicle operation sensor measurement, driver operation data, or CCTV data.

17. A system according to claim 10, wherein the on-board status data includes data on actuation of vehicle doors and the operation profile information includes vehicle door operation requirements at various locations including train stations; and wherein determining operational risks for the vehicle includes comparing the on-board status data on actuation of vehicle doors and vehicle door operation requirements to determine operational risks of door operation failure occurrence.

18. A system according to claim 10, further comprising an on-board railway vehicle condition monitoring system to collect the on-board status data of the vehicle.

19. A method of operating a railway vehicle on a network of tracks forming one or more vehicle routes, the method including:

collecting on-board status data of actual operation of the vehicle using at least one sensor;

providing vehicle status information including the present track location of the vehicle and the on-board status data of actual operation of the vehicle;

providing the route to be taken by the vehicle;

providing operation profile information relating vehicle operational recommendations and/or requirements to track locations and to vehicle routes;

determining operational risks for the vehicle from the vehicle status information, the route to be taken by the vehicle and the operation profile information, each operational risk being the likelihood of future vehicle operation departing from the operation profile information at a given section of track or a given location on the route;

generating advisory notices for a driver of the vehicle on the basis of the operational risks, each advisory notice, when acted on by the driver, reducing the likelihood of future vehicle operation departing from the operation profile information;

wherein determining the operational risks for the vehicle includes comparing the on-board status data of actual operation of the vehicle and the operation profile information to calculate the operational risks;

providing traffic information which includes identification and movement records of vehicles in and around a target area, and signaling and safety data for the target area;

determining, based on the traffic information and the vehicle status information, whether any traffic restrictions are affecting the on-board status data of the vehicle status information; and if traffic restrictions are affecting the on-board status data of the vehicle status information, removing the affected status data from the vehicle status information so as not to use the affected status data in determining operational risks.

20. A system for improving the operation of a railway vehicle on a network of tracks forming one or more vehicle routes, the system including:

a measurement sub-system to obtain vehicle status information including the present track location of the vehicle and on-board status data of actual operation of the vehicle;

a route database storing the route to be taken by the vehicle;

an operation profile database storing operation profile information relating vehicle operational recommendations and/or requirements to track locations and to vehicle routes;

a first processor unit for determining operational risks for the vehicle from the present track location, the route to be taken by the vehicle and the operation profile information, each operational risk being the likelihood of future vehicle operation departing from the operation profile information at a given section of track or a given location on the route;

a second processor unit for generating advisory notices for a driver of the vehicle on the basis of the operational risks, each advisory notice, when acted on by the driver, reducing the likelihood of future vehicle operation departing from the operation profile information; and a driver interface device for presenting the advisory notices to the driver;

wherein determining the operational risks for the vehicle includes comparing the on-board status data of actual operation of the vehicle and the operation profile information to calculate the operational risks;

wherein the on-board status data includes data on actuation of vehicle doors and the operation profile information includes vehicle door operation requirements at various locations including train stations; and wherein determining operational risks for the vehicle includes comparing the on-board status data on actuation of vehicle doors and vehicle door operation requirements to determine operational risks of door operation failure occurrence.

* * * * *